United States Patent [19]

Mousseau et al.

[11] Patent Number: 5,065,862

[45] Date of Patent: Nov. 19, 1991

[54] PLASTIC CAN CARRIER AND METHOD OF MAKING

[75] Inventors: Carlton R. Mousseau, Sylvania; Louis M. DiBello, Perrysburg; Nicholas J. Nicholas, Toledo, all of Ohio

[73] Assignee: Owens-Illinois Plastic Products Inc., Toledo, Ohio

[21] Appl. No.: 541,644

[22] Filed: Jun. 21, 1990

[51] Int. Cl.[5] ..... B65D 71/00; B29F 3/00

[52] U.S. Cl. ..... 206/151; 156/244.25; 206/150; 428/138

[58] Field of Search ..... 206/145, 147, 150, 151, 206/158, 160, 161, 459; 156/243, 244.11, 244.25; 264/171; 428/137, 138

[56] References Cited

U.S. PATENT DOCUMENTS

| | | | |
|---|---|---|---|
| 3,200,944 | 8/1965 | Rapata | 206/161 |
| 3,317,234 | 5/1967 | Burford | 206/145 |
| 3,601,439 | 8/1971 | Poupitch | 206/145 |
| 3,627,121 | 12/1971 | Deasy | 206/151 |
| 3,874,502 | 4/1975 | Weaver | 206/161 |
| 3,882,219 | 5/1975 | Wiley | 156/244.11 |
| 4,116,331 | 9/1978 | Curry et al. | 206/150 |
| 4,219,117 | 8/1980 | Weaver et al. | 206/150 |
| 4,289,236 | 9/1981 | Ganz et al. | 206/459 |
| 4,289,560 | 9/1981 | Simons | 156/244.25 |
| 4,385,690 | 5/1983 | Olsen | 206/150 |
| 4,385,691 | 5/1983 | Klygis | 206/150 |
| 4,471,010 | 9/1984 | McBriarty | 206/150 |
| 4,501,104 | 2/1985 | Griffin et al. | 206/150 |
| 4,520,924 | 6/1985 | Edwards | 206/150 |
| 4,586,742 | 5/1986 | Lew | 206/150 |
| 4,592,466 | 6/1986 | Walters et al. | 206/150 |
| 4,724,655 | 2/1988 | Lew | 206/150 |

*Primary Examiner*—Jimmy G. Foster

[57] ABSTRACT

A carrier for a container package holding an array of cans each of which has an annular bead on the upper end thereof comprising a sheet of flexible plastic material having a plurality of openings forming an array for receiving the ends of the cans and at least one film of plastic material coextensive with the sheet and bonded to the periphery of the sheet. The sheet is made as a coextruded sheet comprising a first relatively thicker layer and a second relatively thin layer adjacent the film. The second layer has a melting point lower than that of the first layer or the film and facilitates the bonding of the film to the sheet by heat. In a modified form two layers of film are bonded to the sheet.

15 Claims, 7 Drawing Sheets

PLASTIC CAN CARRIER AND METHOD OF MAKING

This invention relates to container packages and particularly to carriers for container packages and the method of making such carriers.

BACKGROUND AND SUMMARY OF THE INVENTION

In the handling and the packaging of cans, it is common to use a carrier having an array of openings therein for receiving the upper ends of the cans and holding an array of cans to form a container package. Typical United States patents showing such a carrier are U.S. Pat. No. 3,874,502 and U.S. Pat. No. 4,219,117.

Such a carrier comprises a series of bands or rings which are non-circular and is applied by lateral stretching by a machine which inserts fingers into the openings to stretch the openings to a generally circular configuration and then the carrier is forced onto the upper end of the cans through the neck below the chime or bead on the cans. During the stretching and application, the bands are folded downwardly along the peripheral surface of the necks of the cans. The resultant package comprised a plurality of array of the cans surrounded by the stretched plastic rings. In such a package, the upper ends of the cans are exposed. The package offers no area wherein the carrier can be provided with printing, advertising or other indicia. Furthermore, once the cans are removed from the carrier, it is difficult if not impossible to reinsert the cans. Accordingly, the cans can not be readily handled for returning the cans for salvage or reclaiming.

In U.S. Pat. No. 4,911,290, having a common assignee with the present application, there is disclosed and claimed a container package comprises an array of cans and a carrier. The carrier includes a sheet of stiff but flexible plastic material having a plurality of openings forming an array for receiving the ends of the cans and a film of plastic material coextensive with the sheet and bonded to the periphery of the sheet so that it is flat and taut on the sheet. The cans are inserted upwardly into the openings and retained by the carrier by flexing of the periphery of each opening upwardly against the chime or bead of each can. As the cans are inserted, the film is stretched taut over the upper ends of the cans. The film is stretched substantially flat and taut from one peripheral edge to an opposite peripheral edge. The carrier thus protects the cans from contaminants. The carrier supports the array of the cans so that the upper ends of the cans are in a single plane when the package is lifted through finger openings in the film and sheet. The film and sheet define a substantially flat planar upper surface. Indicia such as printing, advertising. logos artwork and other markings are provided on the film preferably on the entire surface of the film.

The aforementioned patent describes a method of making carriers by first passing a plastic sheet through a rotary cutting die forming a strip with openings and then feeding the strip and a web of film from a roll between a heated roller that has longitudinal heated ribs that bond the film to a strip of carriers along the periphery. Transverse ribs comprise spaced ribs thereby defining separate carriers that can be severed. The transverse ribs comprise ribs of double widths so that when the carriers are subsequently cut from the web, a desired peripheral edge is provided. Roll includes arcuate bonding portions for bonding the portions from which tabs are to be formed.

The web of carriers is then passed through a die cutting roll which includes cutting edges that trim the side edges, cutting portions that trim the corners, and cutting edges that simultaneously form the fingers tabs.

By this method, a roll of carriers is provided that can then be applied to successive arrays of cans.

In utilizing such a method of making a strip of interconnected carriers, it has been found that the rate of production is limited. If the heated roller is rotated rapidly, insufficient bonding is provided between the film and the strip of sheet material. If the heated roller is rotated at a low speed, sufficient to provide proper bonding, the heat tends to melt and burn through the film so that a proper bonding is not achieved.

Accordingly, among the objectives of the present invention are to provide a carrier which can be made rapidly at high speeds without melting and burning through the film; which produces a proper bond of the film to the sheet strip; and which is produced by method that obviates the aforementioned problems.

In accordance with the invention, a carrier for a container package holding an array of cans each of which has an annular bead on the upper end thereof comprises a sheet of flexible plastic material having a plurality of openings forming an array for receiving the ends of the cans and at least one film of plastic material coextensive with the sheet and bonded to the periphery of the sheet. The sheet is made as a coextruded sheet comprising a first layer relatively thick and a second relatively thin layer adjacent the film. The second layer has a melting point lower than that of the first layer or the film and facilitates the bonding of the film to the sheet by heat. In a modified form two layers of film are bonded to the sheet.

DESCRIPTION

Figure 1:
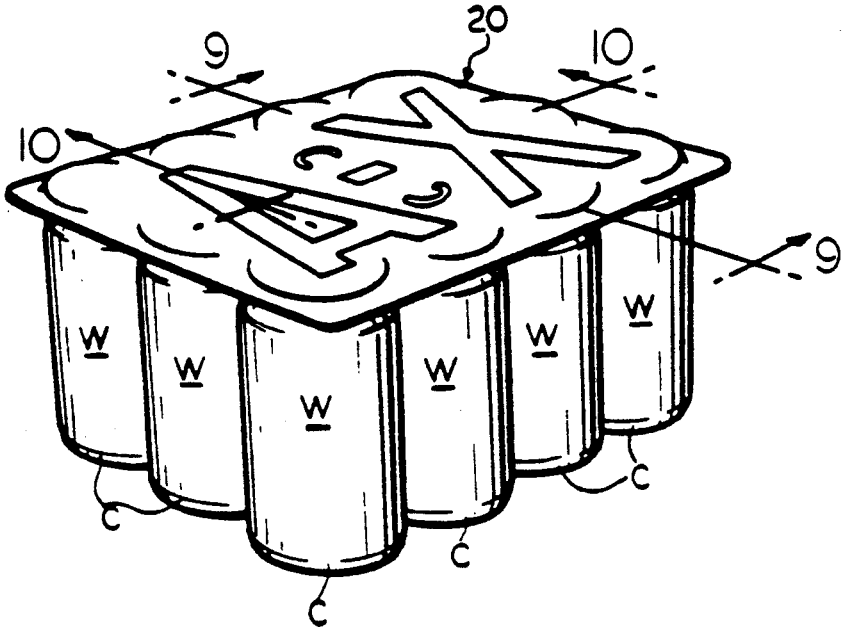
FIG. 1 is a perspective view of a container package embodying the invention.

Referring to FIG. 1, the container package embodying the invention comprises a carrier 20 including a plurality or array of containers C, such as 12 cans, supported so the side wall W of the containers C are in adjacent abutting relation. As is common in cans, the cans include an annular chime or bead B that is connected to the side wall W by a tapered neck portion N.

Referring to FIGS. 2-6, the carrier 20 comprises a sheet 21 which is preferably made of relatively stiff flexible plastic of uniform thickness which is generally rectangular and has a plurality of openings 22 corresponding in number to the number of cans for the package, preferably twelve. The openings 22 have a cross sectional area slightly less then the diameter of the cans below the bead B. As shown, the openings 22 are circular.

The carrier 20 further includes a relatively thin film 23 which is thinner then the sheet 21 and is coextensive with the sheet 21 and bonded about the periphery 24. The bonding at the periphery of the lines is preferably by heat. The carrier 20 further includes portions partially cut to form arcuate slots 25 in the film 23 and sheet 21 to define tabs 26 (FIG. 2), each of which comprises a layer of plastic from the carrier sheet 21 and a layer of plastic from the film 23. Tabs 26 are adapted to be bent downwardly to provide openings to receive the fingers of a hand in order to lift and carry the package, the openings being preferably spaced transversely of one another. Arcuate bonding lines 27 are provided about the periphery of the tabs the tabs 26 minimizing the likelihood of detachment of the film from the sheet at the tabs.

Figure 9:
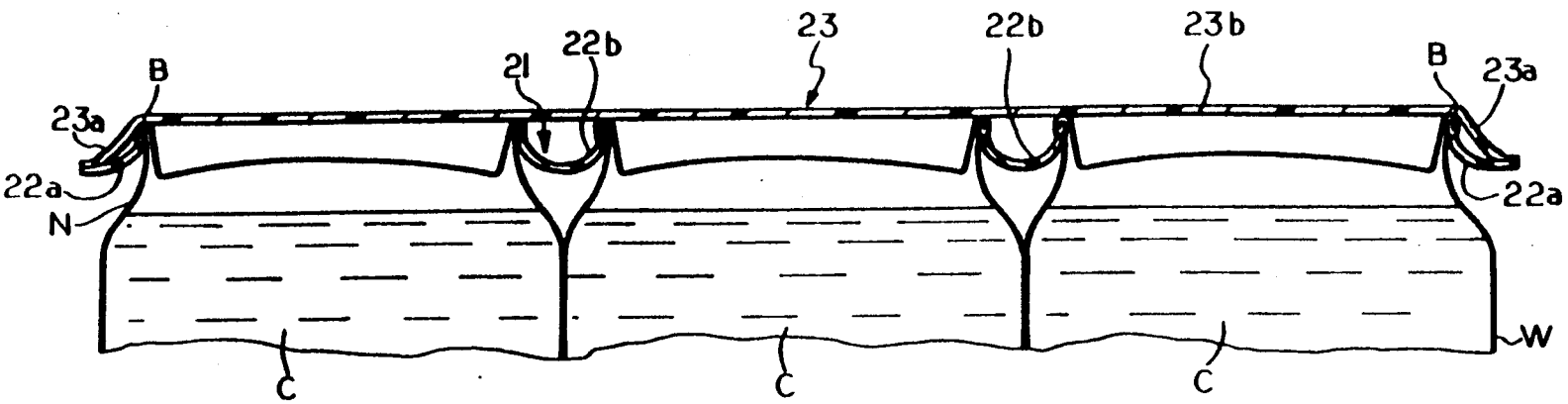
FIG. 9 is a fragmentary longitudinal sectional view of a portion of a package taken along the line 9—9 in FIG. 1.
Figure 10:
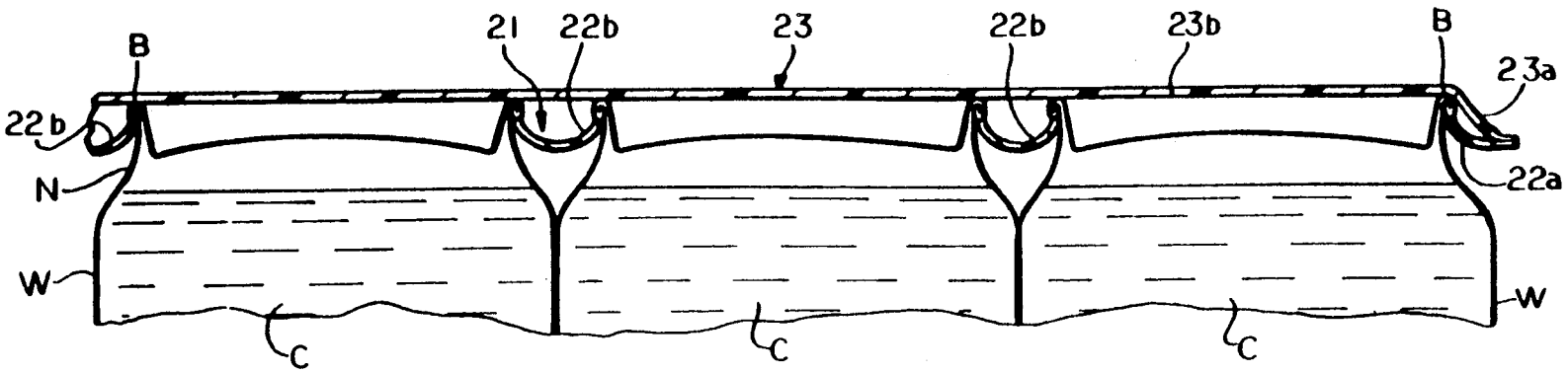
FIG. 10 is a fragmentary sectional view of a portion of a package taken along the line 10—10 in FIG. 1.

As shown in FIGS. 9 and 10, when the carrier 20 is applied to the cans either by progressively forcing the carrier downwardly onto an array of cans from one end of the array to the other or by simultaneously forcing the carrier downwardly onto the array, the portions 22*a* of the periphery of the openings 22 are flexed upwardly about the beads B of the cans C and then flexed radially inwardly below the beads B. It may be noted that the periphery of the portion of the carriers surrounding the opening flexes only sufficiently to extend upwardly beneath the bead but preferably not such that it is stretched and engages and conforms to the neck N of the can C as occurs in conventional ring type can carriers. Such ring type carriers that are commercially used at the present time are shown in the aforementioned U.S. Pat. Nos. 3,874,502, 4,219,177 and 4,586,742.

In a longitudinal direction, the film 23 is flexed about the upper ends of the cans so that the portion 23*a* of the film at the periphery is inclined upwardly and inwardly toward the tops of the peripheral cans and the remainder of the film between the peripheral edges in the longitudinal direction is taut and extends generally parallel to the sheet 21 or horizontally when the package is on a horizontal surface. The entire portion 23*b* overlying the cans is taut and extends horizontally. Similarly in a transverse direction, the film portions 23*a* at the periphery are also inclined upwardly and inwardly toward the tops of the cans and the portion 23*b*. The entire portion 23*b* of the film over the tops of the cans is taut and extends horizontally.

Figure 2:
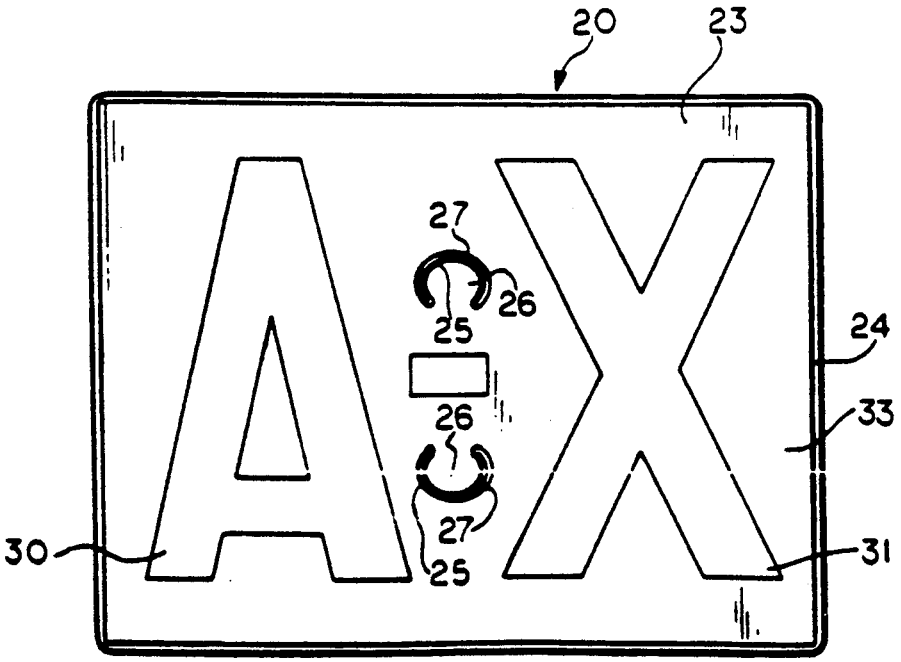
FIG. 2 is a plan view of the carrier utilized in the package as shown in FIG. 1.
Figure 3:
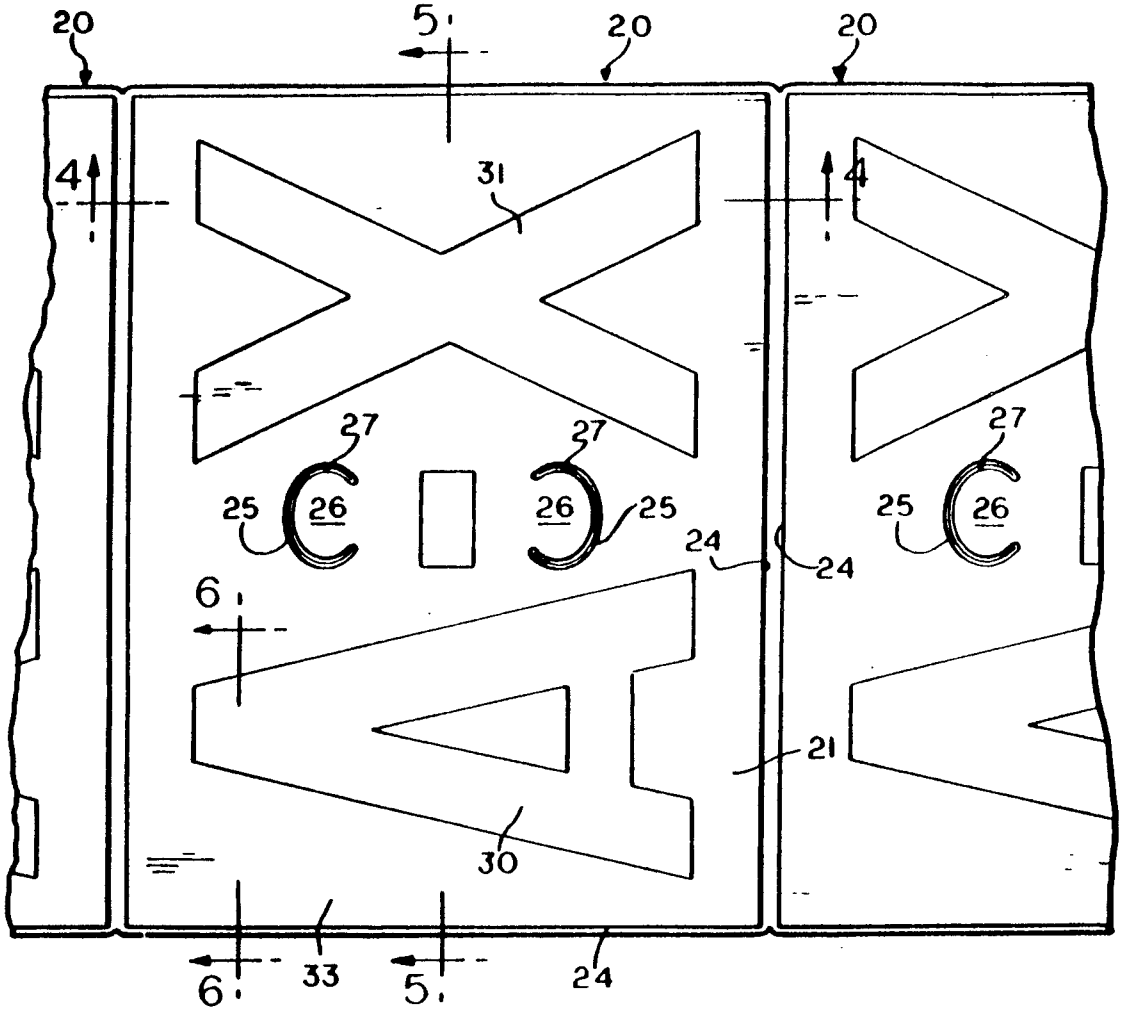
FIG. 3 is a plan view of the portion of a roll of carriers utilized in the package.
Figure 4:
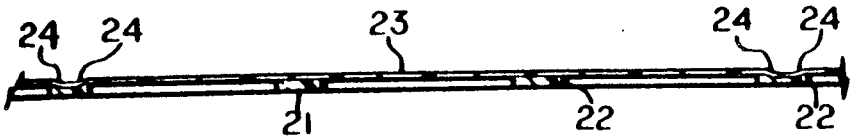
FIG. 4 is a longitudinal sectional view taken along the line 4—4 in FIG. 3.
Figure 5:
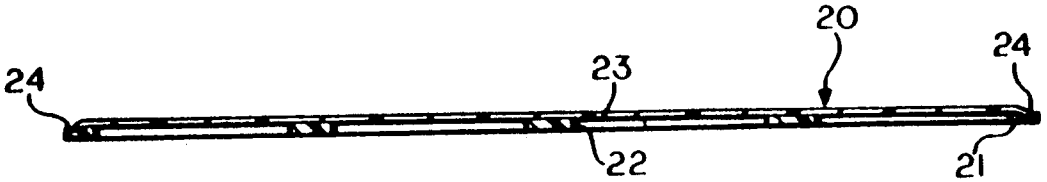
FIG. 5 is a longitudinal sectional view through the package taken along the line 5—5 in FIG. 3.
Figure 6:
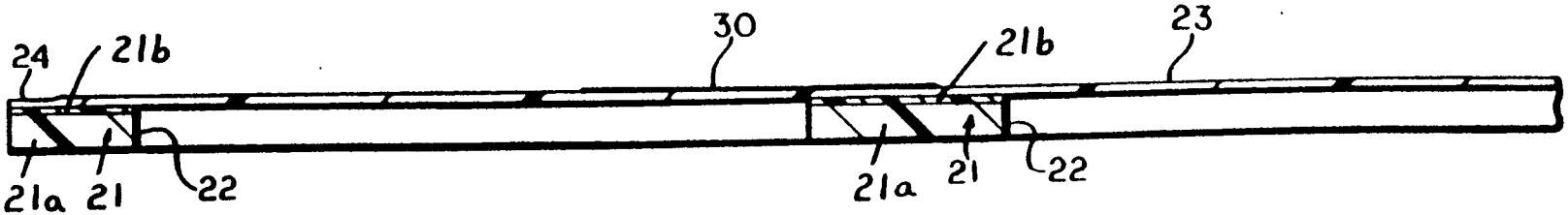
FIG. 6 is a fragmentary sectional view taken along the line 6—6 in FIG. 3.

As shown in FIG. 2, the indicia 30, 31 and other markings 33 or background may be applied by printing on the outer surface of the film 23. Alternatively, the indicia may comprise an opaque color to the film or sheet.

It has been found that the film 23 is substantially uniformly stretched from one peripheral edge to the opposite peripheral edge. As a result, the indicia can be applied over the entire surface of the carrier without unsightly distortion of the indicia by the stretching of the film 23 during application.

Figure 7:
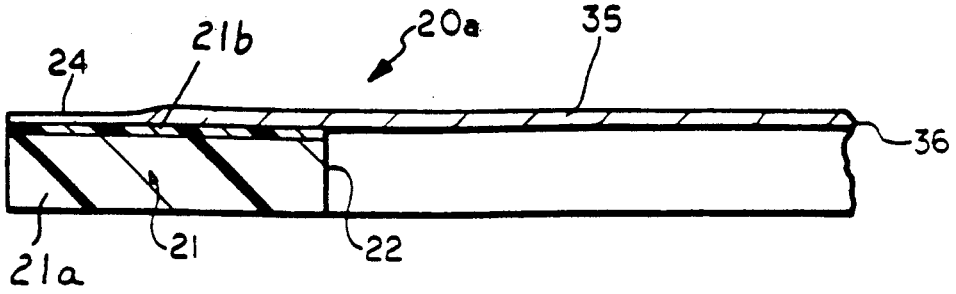
FIG. 7 is a fragmentary sectional view on an enlarged scale of a portion of a modified form of the carrier.

In a form of carrier 20 shown in FIG. 7, film 35 is transparent and the indicia 36 are provided on the underside of the film 35. In all other respects this form is constructed like that shown in FIGS. 1-6. This form has the advantage of protecting the indicia from scuffing when packages are handled or stacked on one another for shipping or display.

Figure 8:
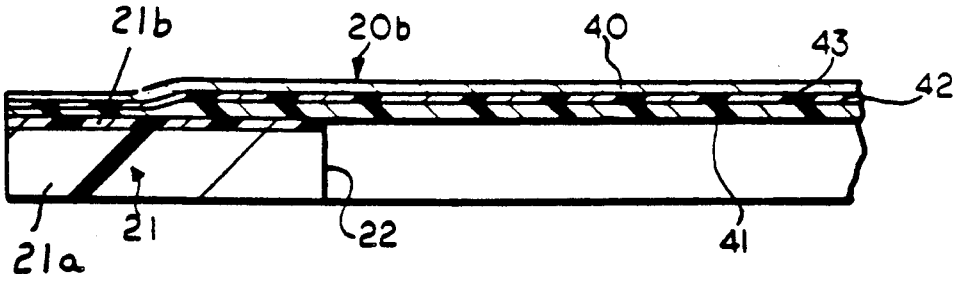
FIG. 8 is a fragmentary sectional view on an enlarged scale of a portion of a further modified form of carrier.

In the form of carrier 20*b* shown in FIG. 8, the film comprised an outer transparent film layer 40 having indicia 43 on the underside of layer 40 and an inner film layer 41. The indicia 43 are formed on the inner surface of layer 40 or 41. An adhesive 42 may be provided to bond the two layers to one another to form a single film.

It can thus be seen that where the indicia are provided on the underside of the film, they are less subjected to abrasive action of the cans on another package during the application to the cans, normal handling, storage and stacking of one package on another. Where the indicia are provided between two layers of film, abrasive action of the printing ink with the upper ends of the cans in the package, which might mar the indicia, is obviated.

In the form of the carrier shown in FIGS. 9 and 10, the carrier 20*c* is similar to that shown in FIG. 8 except that the transparent layer 40*a* having indicia on the underside and film layer 41*a* are not bonded by an adhesive to one another. By this arrangement, when the carrier is applied to the array of cans, the outer film layer 40*a* and the inner film layer 41*a* can slide or move relative to one another minimizing any tendency to deform or mar the indicia 43*a* during application of the carrier to the cans.

The aforementioned constructions are disclosed in the aforementioned U.S. Pat. No. 4,911,290 that is incorporated herein by reference.

In accordance with the invention, in each of the forms of the invention, the sheet 21 comprises two coextruded layers, a relatively stiff flexible plastic layer 21*a* of uniform thickness and a second layer 21*b* coextruded with the first layer and being substantially thinner than the first layer and bonded to the film or films. Further, the coextruded second layer 21*b* has a melting point less than that of the first layer 21*a* and less than that of the film or films which are bonded to the sheet 21.

In accordance with the invention, the first thick layer 21*a* of plastic is substantially thicker than the second layer 21*b* and the film or films bonded to the sheet are thicker than the second coextruded layer.

In a preferred example, the sheet comprises high density polyethylene as the first layer 21*a* and ultra low density polyethylene as the coextruded layer 21*b* and the film or films comprise an outer film or films having a total thickness of 2.5 mils. Where no films are used, the outer layer having a thickness of 1.5 mils, the inner layer having a thickness of 1 mil, and the coextruded layer 21*b* having a thickness of at least 0.5 mil but preferably 0.75 mil while the sheet has a thickness of 13.5 mils. Satisfactory result from the standpoint of bonding of the films to the coextruded sheet are achieved with such a sheet.

Specifically, in a preferred form, the first layer 21a of the coextruded sheet has a thickness of 13.50 mil and comprises high density polyethylene having a melting point of 135° C., density of 0.960 and a melt index of 0.3, made by Allied Signal Inc., and sold under the designation Paxon AA60-003; the coextruded layer having a thickness of 0.75 mil comprises ultra low density polyethylene having a melting point of 105°-110° F. and a softening point of about 90° F., density of 0.905 and a melt index of 0.8, made by Dow Chemical Company and sold under the designation Attane 4003; an intermediate film having a thickness of 1 mil and comprising an ultra low density polyethylene having a melting point of 120° F., a density of 0.912 and a melt index of 3.3 and sold by Dow Chemical Company under the designation Attane 4004; and the top film layer comprises a linear low density polyethylene layer having a melting point of 128° F. and a thickness of 1.5 mil, a density of 0.920, a melt index of 1 and sold by Dow Chemical Company under the designation Dowlex 2045.

Alternatively, EVA, EEA and other low melting copolymers may be used as the coextruded layer.

Figure 11:
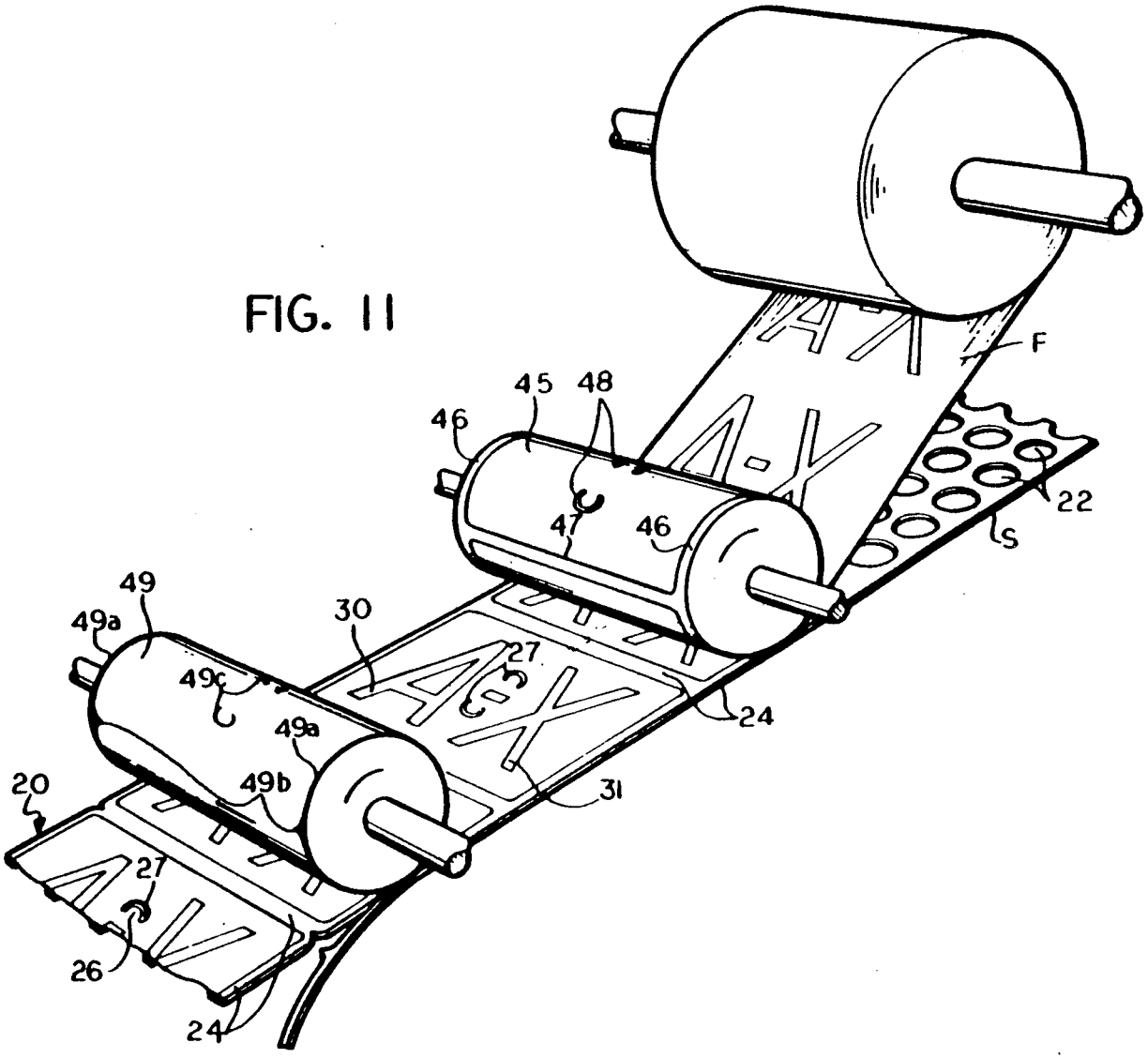
FIG. 11 is a schematic perspective view showing the making the carrier.
Figure 12:
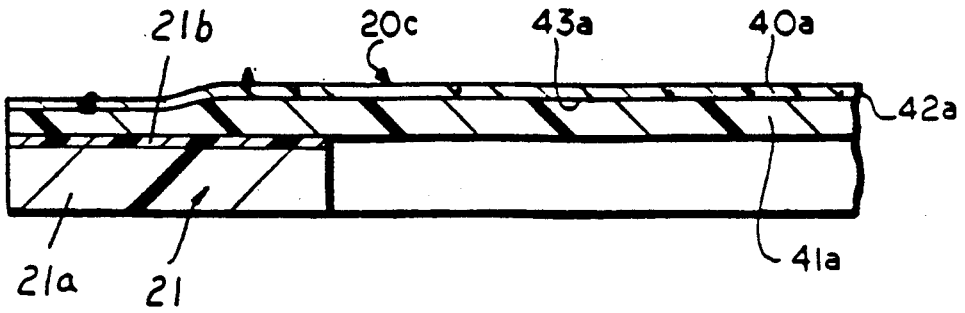
FIG. 12 is a fragmentary sectional view on an enlarged scale of a portion of an additional form of carrier.
Figure 13:
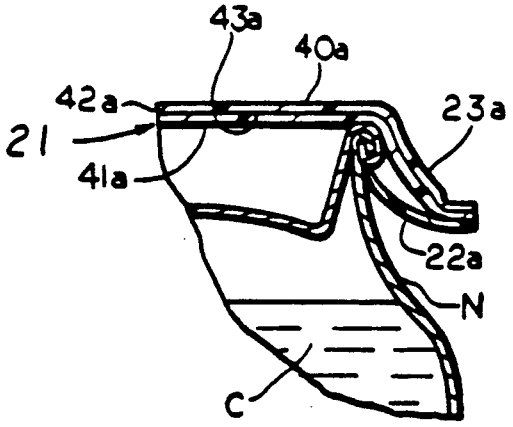
FIG. 13 is a fragmentary sectional view of a portion of a package utilizing the carrier shown in FIG. 12.

Referring to FIG. 11, the carriers are preferably formed by first forming a strip S with openings 22 and feeding the strip S and a web of film F from a roll between a heated roller 45 that has longitudinal heated ribs 46 that bond the film to a strip of carriers along the periphery 24. Transverse ribs 47 comprise spaced ribs thereby defining separate carriers that can be severed. The transverse ribs 47 comprise ribs of double widths so that when the carriers are subsequently cut from the web, a desired peripheral edge 24 is provided. Roll 45 included arcuate bonding portions 48 for bonding the portions from which tabs 26 are to be formed.

The web of carriers are then passed through a die cutting roll 49 which includes cutting edges 49a that trim the side edges, cutting portions 49b that trim the corners, and cutting edges 49c that simultaneously form the finer tabs 26.

By this method, a roll R of carriers is provided that can then be applied to successive arrays of the cans.

It can thus be seen that a carrier has been provided which can be made rapidly at high speeds without melting and burning through the film; which produces a proper bond of the film to the sheet strip; and which is produced by method that obviates the aforementioned problems.

We claim:

1. The method of making a carrier for a container package for cans having a top, a peripheral bead, a side wall and an inclined portion extending upwardly and inwardly toward the bead, said method comprising coextruding a web of coextruded plastic comprising a first layer and a second layer, said second layer having a melting point less than that of said first layer, forming said web into a plurality of interconnected sheet portions of flexible plastic material, each sheet portion having a plurality of openings for receiving the upper ends of the cans, and successively heat bonding at least one film of plastic material at the isolated areas to the upper surfaces of each sheet portion of said to form a continuous laminated web of carriers of film and sheet portions, said second layer of the coextruded plastic web having a melting point less than that of said film.

2. The method set forth in claim 1 wherein said step of extruding said coextruded web is such that said first layer of said web has a thickness greater than said second layer.

3. The method set forth in claim 2 wherein said web has a thickness greater than that of said film and said film has a thickness greater than second layer of said coextruded web.

4. The method set forth in claim 1 including the step of interposing an intermediate film layer interposed between said first-mentioned film layer and said carrier and simultaneously bonding said intermediate layer at said isolated areas, said second layer of said web having a melting point less than that of said intermediate layer.

5. The method set forth in claim 4 wherein said step of extruding said coextruded web is such that said first layer of said web has a thickness greater than said second layer.

6. The method set forth in claim 5 wherein said web has a thickness greater than the thickness of said films and said films have a thickness greater than said second layer of said web.

7. The method set forth in any of claims 1-6 wherein said second layer of said coextruded web has a thickness of at least 0.5 mils.

8. The method set forth in any of claims 1-6 wherein said bonding is at the side edges and transversely of each sheet portion.

9. A carrier for a container package holding an array of cans, each of which has an annular bead on the upper end thereof comprising a sheet of flexible plastic material having a plurality of openings forming an array for receiving the ends of the cans and at least one film of plastic material coextensive with said sheet and bonded to isolated portions of said sheet, said sheet being made as a coextruded sheet comprising a first layer and second layer, said second layer having a melting point lower than that of said first layer or said film thereby facilitating the bonding of the film to the sheet by heat.

10. The carrier set forth in claim 9 wherein said first layer of said sheet carrier has a thickness greater than said second layer.

11. The carrier set forth in claim 10 wherein said sheet has a thickness greater than that of said film and said film has a thickness greater than second layer of said coextruded web.

12. A container package comprising an array of cans, each of which has an annular bead on the upper end thereof comprising a sheet of flexible plastic material having a plurality of openings forming an array receiving the ends of the cans and at least one film of plastic material coextensive with said sheet and bonded to isolated portions of said sheet, said sheet being made as a coextruded sheet comprising a first layer and second layer, said second layer having a melting point lower than that of said first layer or said film thereby facilitating the bonding of the film to the sheet by heat.

13. The carrier set forth in claim 12 wherein said sheet has a thickness greater than the thickness of said films and said films have a thickness greater than said second layer of said web.

14. The carrier set forth in claim 13 wherein said second layer of said coextruded web has a thickness of at least 0.5 mils.

15. The carrier set forth in claim 12 including a second film interposed between said sheet and said first-mentioned film and heat bonded thereto at said isolated portions, said second layer having a melting point lower than that of said second film.

* * * * *